US006516546B1

(12) United States Patent
Bremick

(10) Patent No.: US 6,516,546 B1
(45) Date of Patent: Feb. 11, 2003

(54) DISPLAY PLACARD FOR LADDERS

(75) Inventor: Lori J. Bremick, Louisville, KY (US)

(73) Assignee: Louisville Ladder Group, LLC, Louisville, KY (US)

( * ) Notice: Subject to any disclaimer, the term of this patent is extended or adjusted under 35 U.S.C. 154(b) by 0 days.

(21) Appl. No.: 09/649,127

(22) Filed: Aug. 28, 2000

(51) Int. Cl.[7] ..... G09F 1/00
(52) U.S. Cl. ..... 40/124.01; 182/129; 40/539
(58) Field of Search ..... 40/124.01, 124.09, 40/539, 750, 754, 665, 316, 317; 182/129, 18; D25/68, 69; 206/806; 24/16 PB

(56) References Cited

U.S. PATENT DOCUMENTS

| | | | | | |
|---|---|---|---|---|---|
| 361,212 | A | * | 4/1887 | Dormitzer | 182/129 |
| 405,851 | A | * | 6/1889 | Schlyer | 40/617 |
| 627,920 | A | * | 6/1899 | Gould | 40/6 |
| 1,860,547 | A | * | 5/1932 | Marsh | 40/310 |
| 2,468,397 | A | | 4/1949 | Goldstein | |
| 2,605,566 | A | | 8/1952 | De Dell, Jr. | |
| 3,009,276 | A | | 11/1961 | Stelzer | |
| 3,311,195 | A | * | 3/1967 | Singer | 182/129 |
| 4,379,372 | A | | 4/1983 | Alexander et al. | |
| 4,760,660 | A | | 8/1988 | Fast | |
| 4,761,904 | A | | 8/1988 | Fast et al. | |
| 4,779,367 | A | | 10/1988 | Fast | |
| 4,856,214 | A | | 8/1989 | Machen | |
| 4,869,007 | A | | 9/1989 | Fast | |
| 5,425,546 | A | * | 6/1995 | Gerber et al. | 40/308 |
| 5,493,801 | A | | 2/1996 | James | |
| 5,918,316 | A | * | 7/1999 | Nathanson et al. | 40/329 |

FOREIGN PATENT DOCUMENTS

| | | | | |
|---|---|---|---|---|
| CH | 207330 | * | 10/1939 | 40/320 |
| DE | 4017945 | * | 12/1991 | 182/129 |

* cited by examiner

*Primary Examiner*—Cassandra H. Davis
(74) *Attorney, Agent, or Firm*—Harness, Dickey & Pierce, P.L.C.

(57) ABSTRACT

In combination with a ladder that comprises a pair of stiles connected by a plurality of spaced steps or rungs, a point of sale display placard is secured on the one of the steps or rungs. The placard includes a panel having first and second ends. A plurality of segments are formed at the first end, connected by folds to form an enclosure surrounding the rung. The portion of the placard adjacent the second end engages a portion of the ladder so that the panel remains generally parallel to the plane of the ladder.

12 Claims, 5 Drawing Sheets

DISPLAY PLACARD FOR LADDERS

BACKGROUND OF THE INVENTION

This invention relates to a display placard, and in particular to a point-of-purchase display placard for ladders.

It is particularly difficult to put informational or advertising displays on ladders, because a ladder's open configuration makes it difficult to attach signage, and a ladder's size usually makes it impractical to put the ladder in a container or box. Thus, information and advertising displays for ladders are generally secured to the styles, or some other part of the ladder. Such displays can be cumbersome and time consuming to apply. Such displays are generally small, and are often not clearly visible when the ladder is on display.

SUMMARY OF THE INVENTION

The present invention is a point-of-sale display placard that is of simple and inexpensive construction, and which can be quickly and easily secured to a ladder. The placard provides a large, visible display surface, that is both securely attached to the ladder, and held in position so that it remains visible during the transportation, storage, display, and sale of the ladder. The display placard can be formed from a blank having a portion that be manually folded around a portion of the ladder and secured, without the need for special tools or separate fasteners.

Generally, the display placard of the present invention is formed from a blank having first and second ends. At least two segments are formed in the blank at the first end by at least two fold lines to permit the segments to be folded around the rung of a ladder and secured to the placard to encircle the rung of the ladder, thereby securing the placard to the ladder. There is preferably a tab on the first end of the blank, and a slot in the blank adapted to receive and engage the tab on the first end, to secure the placard around the rung. In the preferred embodiment there are three segments at the first end of the blank, which when folded around the rung of ladder form an enclosure of rectangular cross section around the rung of the ladder.

The display placard is secured to a rung or step of the ladder with the enclosure formed by the segments surrounding the rung or step. The second end of the blank engages some other portion of the ladder, such as an adjacent rung or step, the stiles of the ladder, or perhaps gussets, to hold the panel portion generally in the plane of the ladder, so that it remains visible to someone looking at the front of the ladder.

Thus the display placard of the present invention provides a simple and inexpensive point-of-purchase display that can be quickly installed on the ladder, which remains securely on the ladder while the ladder, is transported, stored, displayed, and sold, but which can be easily removed by the consumer after purchase. The display placard is configured to remain prominently in view in the front elevation of the ladder, so that the information on the placard is and remains readily visible. The placard can be provided in the form of an inexpensive blank that is easy to fabricate, and compact for storage. These and other features and advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE INVENTION

Figure 1:
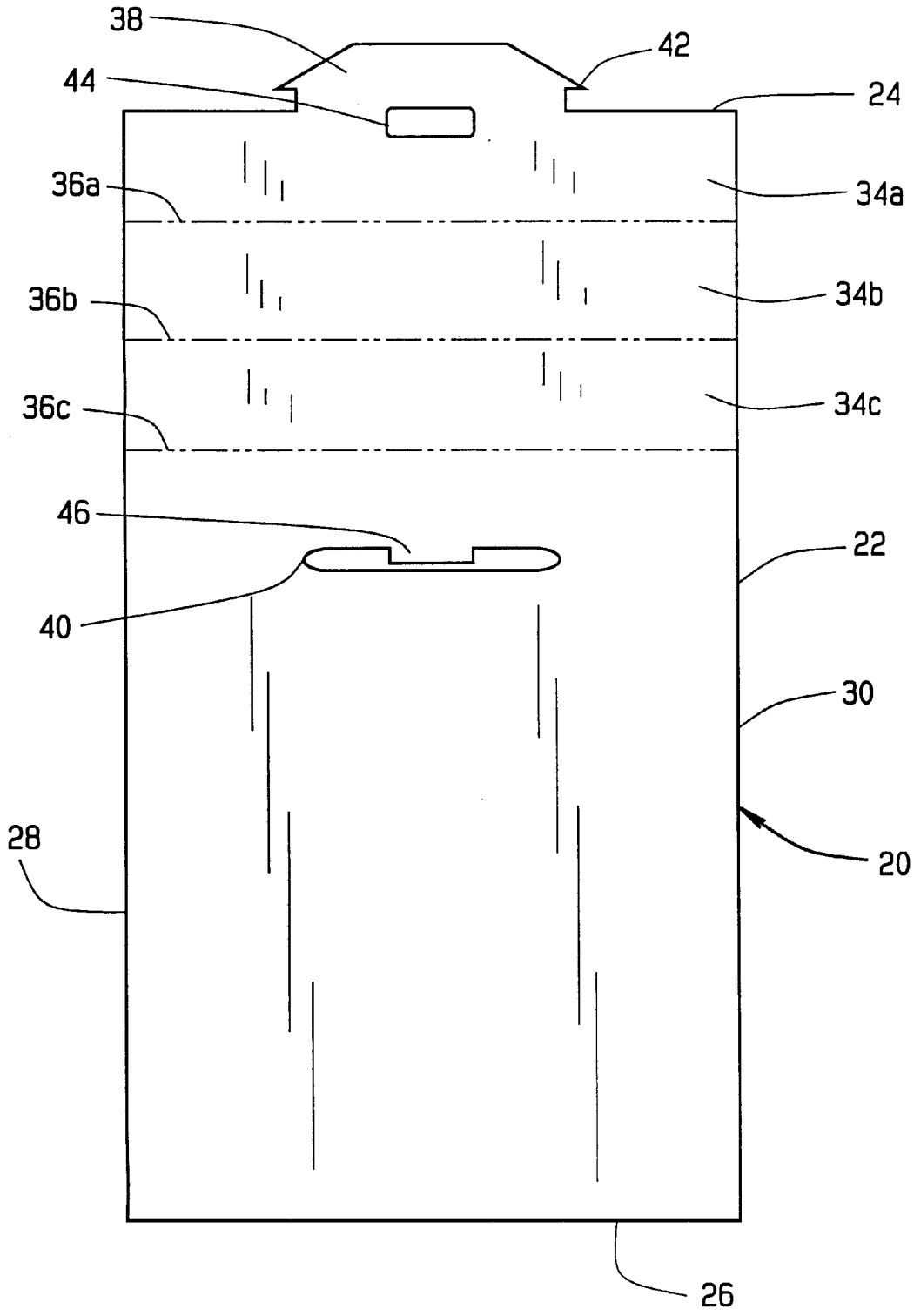
FIG. 1 is a front elevation of a first embodiment of a blank for a point-of-sale display placard constructed according to the principles of the present invention.

A blank for a point-of-sale display placard constructed according to the principles of the present invention is indicated generally as 20 in FIG. 1. The blank has a front face 22, and a back face, a first end 24 and a second end 26, and left and right side edges 28 and 30. The blank includes a panel portion 32 onto which information and illustrations can be printed or affixed. The blank 20 is preferably made from a flat, relatively rigid material such as a corrugated cardboard. There are at least two segments 34 formed at the first end 24 of the blank 20 by at least two fold lines 36. In the preferred embodiment shown and described herein, there are three segments 34*a*, 34*b*, and 34*c*, formed by fold lines 36*a*, 36*b*, and 36*c*. The fold lines 36 can be, for example, creases pre-formed in the material of the blank so that the blank is pre-disposed to fold in a straight line along the crease. Thus the segments can be wrapped around the rung or step of a ladder, and once secured to the placard, encircle the rung or step, securing the placard to the ladder.

In the preferred embodiment there is a tab 38 on the first end 24 of the blank 20, that is adapted to fit in a slot 40 in the panel portion 32 of the blank so that the segments 34 and a portion of the panel 32 form an enclosure around the rung or step of the ladder. As shown in FIG. 1, the tab 38 has barbs 42 on each side to help retain the tab in the slot 40. The tab 38 further has an opening 44, which is adapted to be engaged by a tooth 46 in the slot 40, to further secure the tab in the slot. Thus the blank 20 can be formed into a placard that remains secured on the rung or step of a ladder without the need for tools or separate fasteners. The tab 38 and slot 40 help retain the placard on the ladder during shipment, storage, and sale, yet the placard can be easily removed by the ultimate consumer.

Figure 2:
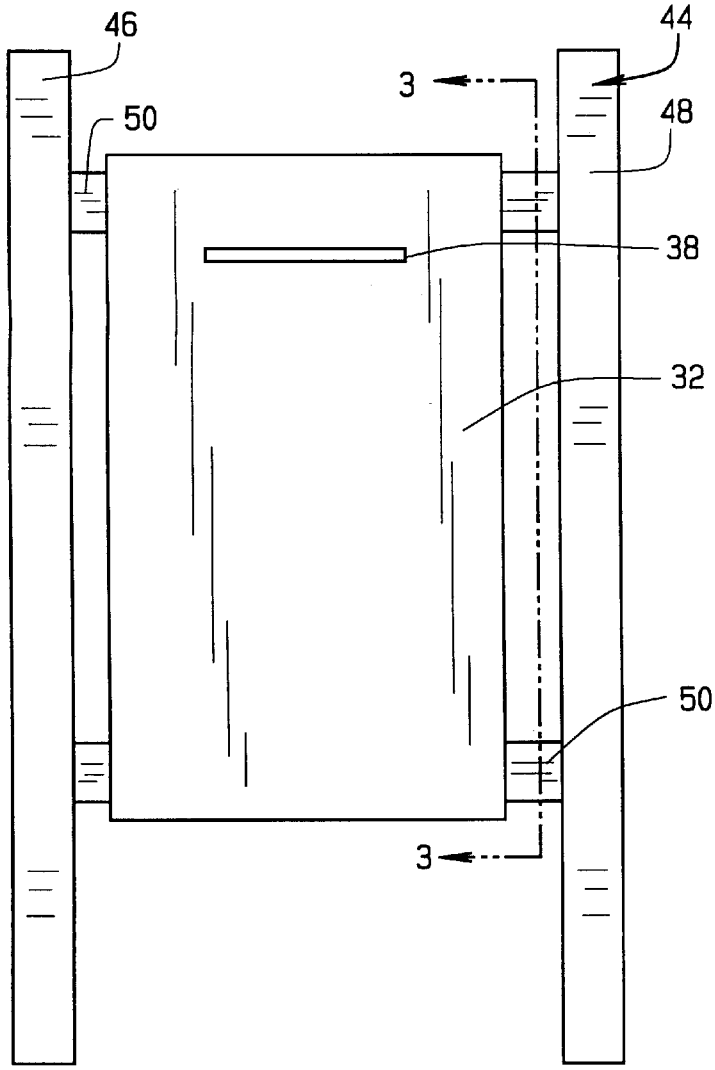
FIG. 2 is a front elevation view of the placard shown as it would be secured on the rung or step of a conventional ladder.
Figure 3:
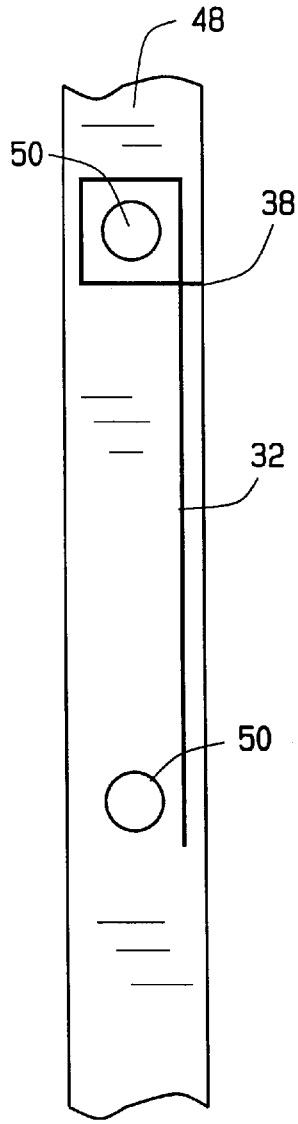
FIG. 3 is a vertical cross-sectional view of the placard, taken along the plane of line 3—3 in FIG. 2.

The completed placard made from the blank 20 is shown in FIGS. 2 and 3 as it would be secured on a conventional ladder 44 having stiles 46 and 48, and rungs or steps 50 extending therebetween. As shown in FIG. 3, the segments 34*a*, 34*b*, and 34*c*and the portion of the panel 32 between the slot 40 and the fold line 36*c*, form an enclosure having a generally rectangular cross-section around a rung or step 50. The first end of the blank is secured to the panel portion of the placard by the tab 38 that extends through the slot 40.

The placard, and in particular the panel portion 32 of the placard is preferably sized and shaped for the particular ladder 44, so that the second end (i.e. the end opposite from the end secured to a rung or step of the ladder, engages and is supported by the ladder, holding the placard in position generally in the plane of the ladder, so that the placard stays visible from the front of the ladder. For example, as shown in FIGS. 2 and 3, in the case of ladder 44, the second end of the panel is supported by an adjacent rung 50.

Figure 4:
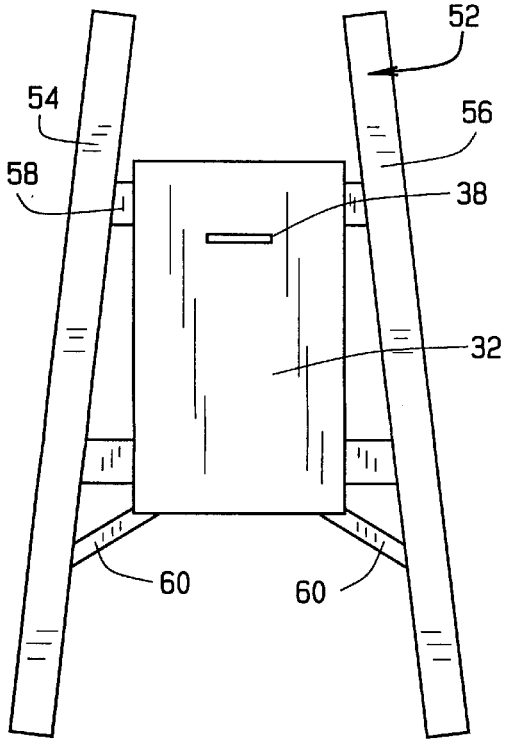
FIG. 4 is a front elevation view of the placard shown as it would be secured on the rung or step of a stepladder.
Figure 4A:
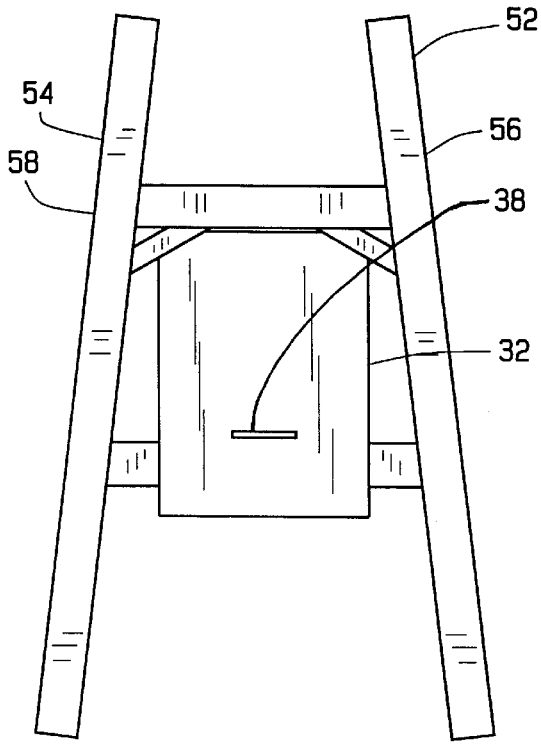
FIG. 4*a* is a front elevation view of the placard on a stepladder, showing an alternate method of the securing placard.

The placard of the present invention is shown in FIGS. 4 and 4*a* as it would be secured on a stepladder 52. The stepladder 52 has converging stiles 54 and 56, and a plurality of rungs or steps 58, supported by gussets 60. As shown in FIG. 4 the placard is secured on a rung with the panel 32 depending downwardly and supported by an adjacent rung and gussets. As shown in FIG. 4*a* the placard is secured on a rung with the panel 32 extending upwardly and supported by an adjacent rung and gussets.

Figure 5:
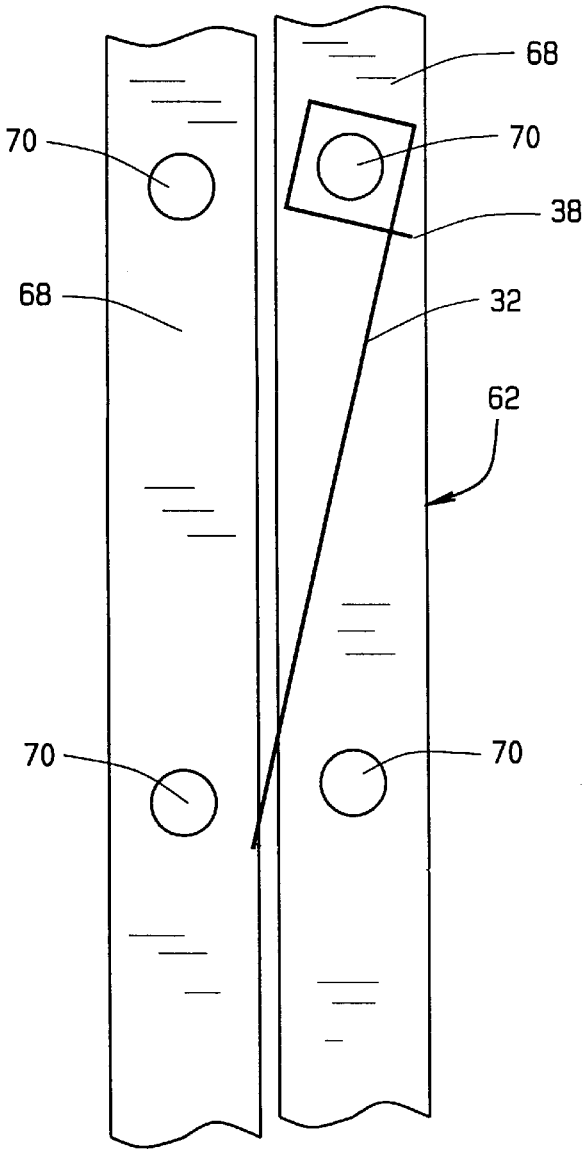
FIG. 5 is a vertical cross-sectional view of the placard shown as it would be secured on an extension ladder.
Figure 5A:
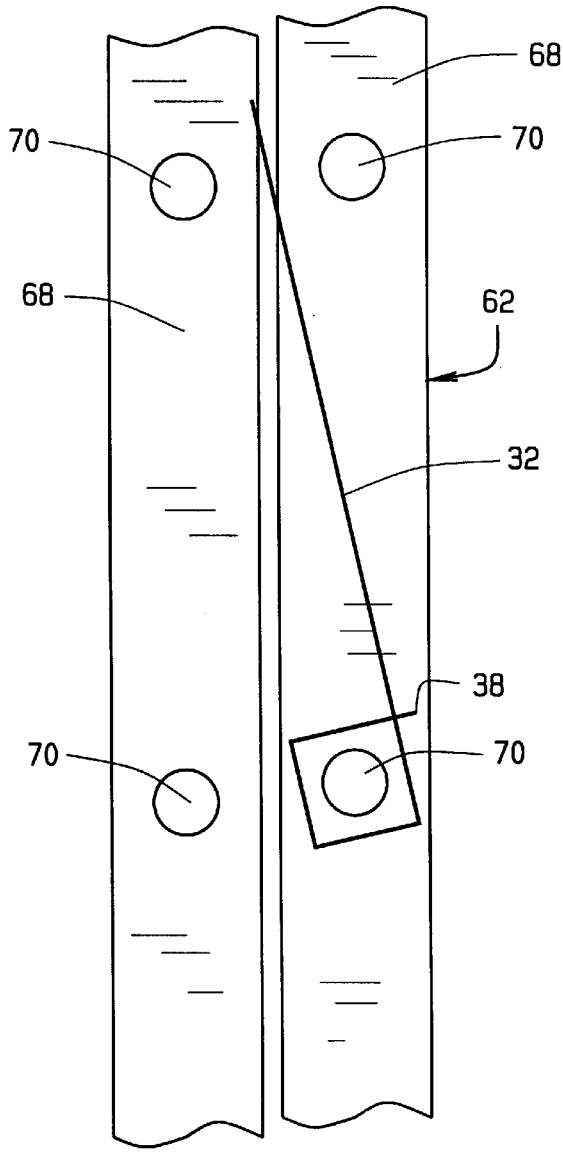
FIG. 5*a* is a vertical cross-sectional view of the placard on an extension ladder, showing an alternate method of securing the placard.

The placard of the present invention is shown in FIG. 5 as it would be secured on an extension ladder 62. The extension ladder 62 comprises first and second ladder sections 64 and 66. Each ladder section comprises stiles 68 and 70, with rungs or steps 72 extending therebetween. The enclosure formed by the segments on the first end of the placard surrounds a rung or step 72 on the first ladder section 64, and the second end of the placard is sized and configured so that it extends between, and is thereby supported by adjacent rungs 72 on the first and second ladder sections 64 and 66. Thus the placard is supported generally in the plane of the ladder 62, so that its panel portion 20 remains visible at substantially all times from the front of the ladder. As shown in FIG. 5 the placard is secured on a rung with the panel 32 depending downwardly. As shown in FIG. 5*a*the placard is secured on a rung with the panel 32 extending upwardly.

Figure 6:
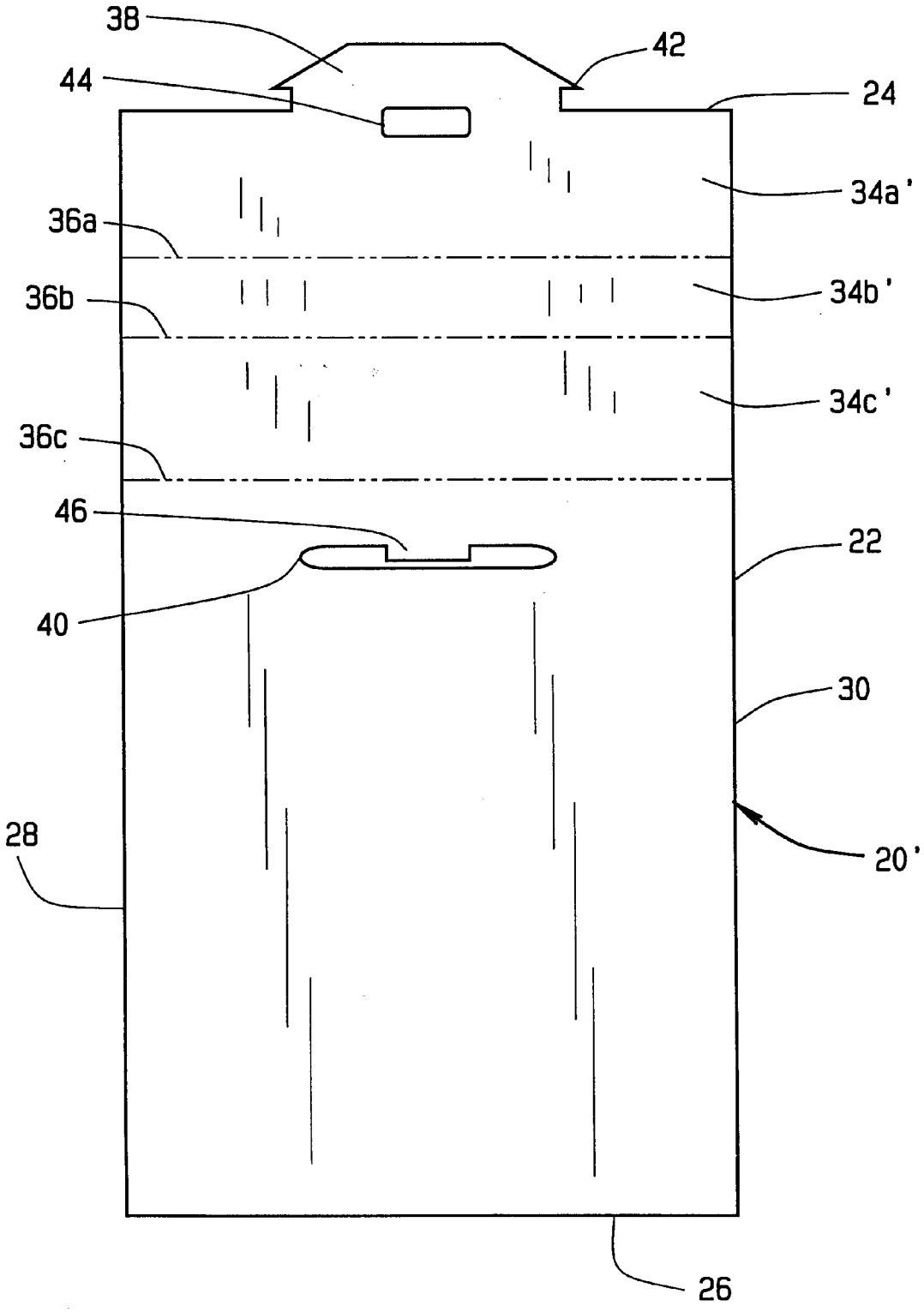
FIG. 6 is a front elevation view of a second embodiment of a blank for a point-of-sale placard constructed according to the principles of this invention.

A second embodiment of a blank constructed according to the principles of this invention is indicated generally as 20' in FIG. 6. The blank 20' is similar to blank 20, and corresponding reference numerals indicate corresponding parts. However, unlike blank 20, in blank 20' the segments 34*a*', 34*b*', and 34*c*' are not of equal size. Thus, when the segments are founded around the rung or step of a ladder, they form a more rectangular and less square enclosure around the rung. This is particularly desirable for stepladders, which typically have flat steps with more elongate cross sections, as compared to a round or nearly round rungs found on conventional ladders.

While both the blanks 20 and 20' of the first and second embodiments are shown with three segments, which together with a portion of the panel form a four sided enclosure, the blanks could have been provided with as few as two segments, which would form an enclosure with a triangular cross section, or more than three segments, which would form an enclosure with a polygonal cross-section such as a pentagon, hexagon, etc.

What is claimed is:

1. A point of sale display placard secure on a rung of a ladder compromising a plurality of rungs arranged generally in a plane, the placard compromising a panel, having first and second ends, and a plurality of segments at the first end of the panel, connected by folds forming an enclosure surrounding the rung, a portion of the panel adjacent the second end engaging portion of the ladder so that the panel remains generally paralled to the plane of the ladder.

2. The point of sale display placard according to claim 1 wherein there is a tab on the distal most segment, and wherein there is a slot in the panel in which the tab is secured to hold the enclosure surrounding the rung.

3. The point of sale display placard according to claim 1 wherein the enclosure has a generally rectangular cross section.

4. The point of sale display placard according to claim 1 wherein a portion of panel adjacent the second end engages a rung or step.

5. The point of sale display placard according to claim 1 wherein a portion of the panel adjacent the second end engages gussets supporting a rung of the ladder.

6. In combination with a ladder that comprises a pair of stiles connected by a plurality of spaced steps or rungs generally in a plane, a point of sale display placard secured on one of the steps and rungs, the placard comprising panel having first and second ends, and a plurality of segments at the first end connected by folds forming an enclosures surrounding the rung, the a portion of the panel adjacent the second end engaging a portion of the ladder so that the panel remains generally parallel to the plane of the ladder.

7. The combination according to claim 6 wherein the placard includes a tab on the distal most segment, and wherein there is a slot on the panel in which the tab is secured to hold the enclosure surrounding the rung.

8. The combination according to claim 6 wherein the enclosure formed by the segments has a generally rectangular cross section.

9. The combination according to claim 6 wherein the portion of the panel adjacent the second end engages a rung or step.

10. The combination according to claim 6 wherein the portion of the panel adjacent the second end engages at least one gusset supporting a rung of the ladder.

11. The combination according to claim 6 wherein the ladder is an extension ladder, comprising first and second relatively slideable ladder section, each section having a pair of stiles connected by a plurality of steps or rungs, and wherein the plurality of segments at the first end connected by fold lines forms an enclosure surrounding a rung on at least one of the sections, the portion of the panel adjacent the second end extending between adjacent rungs of the first and second ladder sections.

12. The combination according to claim 6 wherein the ladder is a folding ladder, comprising first and second hinged ladder sections, each having a pair of stiles engaging a portion of the ladder so that the panel remains generally parallel to the plane of the ladder.

* * * * *